US005585907A

United States Patent [19]

Atsumi et al.

[11] Patent Number: 5,585,907

[45] Date of Patent: Dec. 17, 1996

[54] CHARGING SYSTEM FOR CHARGING THE SURFACE OF A PHOTOSENSITIVE DRUM IN AN IMAGE FORMING APPARATUS

[75] Inventors: Tetsuya Atsumi, Tokyo; Hisashi Fukushima, Kawasaki, both of Japan

[73] Assignee: Canon Kabushiki Kaisha, Tokyo, Japan

[21] Appl. No.: 359,747

[22] Filed: Dec. 20, 1994

[30] Foreign Application Priority Data

Dec. 22, 1993 [JP] Japan ..... 5-324573

[51] Int. Cl.[6] ..... G03G 15/16

[52] U.S. Cl. ..... 355/274; 355/273

[58] Field of Search ..... 355/271, 273, 355/274; 361/220, 221, 225, 230

[56] References Cited

U.S. PATENT DOCUMENTS 3,947,113 3/1976 Buchan et al. ..... 355/271

5,249,022 9/1993 Watanabe et al. ..... 355/271

*Primary Examiner*—William J. Royer

*Attorney, Agent, or Firm*—Fitzpatrick, Cella, Harper & Scinto

[57] ABSTRACT

An apparatus for reducing an image forming time period includes a rotatable image bearing member, a charging device for charging the image bearing member, an image forming device for forming an image on the image bearing member which was charged by the charging device, a transfer material bearing member for holding a transfer material and for conveying the transfer material to a transfer station regarding the image bearing member, a transfer device for electrostatically transferring the image formed on the image bearing member onto the transfer material held by the transfer material bearing member at the transfer station, and a restraint device which prevents the charge on the transfer material bearing member from being transmitted when an area on an image bearing member which is to be compacted with the transfer material held on the transfer material bearing member during image transferring is situated at the transfer station before an operation of the transfer device is started. In the present apparatus, the charging is effected by the charging device, image formation is effected by the image forming device, and image transferring is effected by the transfer device being started during the same one revolution of the image bearing member.

14 Claims, 8 Drawing Sheets

POTENTIAL ON PHOTOSENSITIVE DRUM BEFORE PRE-EXPOSURE

POTENTIAL ON PHOTOSENSITIVE DRUM AFTER PRE-EXPOSURE

POTENTIAL ON PHOTOSENSITIVE DRUM AFTER CHARGE

CHARGING SYSTEM FOR CHARGING THE SURFACE OF A PHOTOSENSITIVE DRUM IN AN IMAGE FORMING APPARATUS

BACKGROUND OF THE INVENTION

1. Field of the Invention

The present invention relates to an image forming apparatus, for example, of electrophotographic type wherein an image is formed by transferring a toner image formed on an image bearing member onto a recording material (transfer material) born on a recording material bearing member.

2. Related Background Art

FIG. 2 shows an example of a color image forming apparatus for forming a full-color image.

In this example, a color image forming apparatus comprises a photosensitive drum (image bearing member) 1 supported for rotation in a direction shown by the arrow. Around the photosensitive drum 1, there are arranged a pre-exposure lamp 11, a corona charger 2, an optical system 3, a developing means 4, a transfer device 5 and a cleaning device 6.

The optical system 3 comprises an original scanning portion and a color decomposing filter. For example, the optical system is a laser beam exposure device for illuminating a color-decomposed light image or equivalent light image E onto the photosensitive drum 1. A latent image is formed on the photosensitive drum by illuminating the color-decomposed light image for each color onto the photosensitive drum 1 which was previously charged uniformly by the corona charger 2. The developing means 4 is rotatable and comprises four developing devices (i.e., black developing device 4B*k*, cyan developing device 4*c*, magenta developing device 4*m* and yellow developing device 4*y*) arranged around a rotary shaft 4*b* so that a selected developing device can be rotated at a developing station where the selected developing device is opposed to the photosensitive drum 1, in order to develop the latent image on the photosensitive drum 1 with negative toner including resin as a main component, thereby forming a toner image.

Further, the toner image formed on the photo-sensitive drum 1 is transferred onto a recording material sent, by a convey system (through a convey path shown by the broken line in FIG. 2), from a recording material cassette 7 to a transfer station where the transfer device 5 is opposed to the photosensitive drum 1. In the illustrated example, the transfer device 5 comprises a transfer drum 5*a*, a transfer charger 5*b*, an absorb corona charger 5*c* for electrostatically absorbing the recording material and an absorb roller 5*g* opposed to the absorb corona charger, an inner corona charger 5*d*, an outer corona charger 5*e*, and an outer corona charger 5*h*. A peripheral opening of the transfer drum 5*a* supported for rotational movement is covered or closed by a cylindrical recording material bearing sheet 5*f* made of dielectric material.

As the transfer drum 5*a* is rotated, the toner image formed on the photosensitive drum 1 is transferred onto the recording material born on the recording material bearing sheet 5*f*, by means of the transfer charger 5*b*. A desired number of color toner images are transferred to the recording material born on the recording material bearing sheet 5*f*, thereby forming a full-color image. After the desired number of toner images were transferred to the recording material, the recording material is separated from the transfer drum 5*a* by a separation means 8, and the separated recording material is discharged onto a tray 10 through a heat roller fixing device 9.

On the other hand, after the transferring operation, the residual toner remaining on the photo-sensitive drum 1 is removed by the cleaning device 6 for preparation for next image formation.

In the past, as shown in FIGS. 7A to 7F, in order to erase the history of the photosensitive drum 1 before the copying operation is started, the photo-sensitive drum 1 was rotated in a direction shown by the arrow until the rotation of the drum was stabilized. Then, the residual charge was removed from the photosensitive drum 1 by energizing a pre-exposure lamp 11 (FIG. 7A), and then, the charge-removed area of the photosensitive drum 1 was uniformly charged by the charger 2 (FIG. 7B). After the charged area was subjected to the electricity removal be means of the pre-exposure lamp 11 (FIG. 7D) and the charging by means of the charger 2 (FIG. 7E) again, the latent image was formed on the photosensitive drum (FIG. 7F). Now, an operation effected from the input of an image information start signal (from an external device) to re-electricity removal on the area of the photosensitive drum once charged by the charger 2 is referred to as a "pre-rotation".

Here, it is considered that a full-color image is formed without performing the conventional pre-rotation. That is to say, as shown in FIGS. 8A to 8C, the photosensitive drum 1 is rotated in a direction shown by the arrow until the rotation of the drum is stabilized. Then, after the pre-exposure lamp 11 is energized and the photosensitive drum is charged by the charger 2, the formation of the latent image is started during the same revolution of the photosensitive drum 1.

By starting the charging by means of the charger 2 and the latent image formation by means of the optical system 3 during the same revolution of the photosensitive drum 1, a time period from the start of the charging by means of the charger 2 to the start of the latent image formation can be reduced in comparison with the conventional example shown in FIGS. 7A to 7F by a time period corresponding to one revolution of the photosensitive drum 1. However, if the pre-rotation is omitted, areas of the photosensitive drum 1 other than the area charged by the charger 2 are rotated while contacting with the recording material bearing sheet 5*f* in a condition that they are not charged by the charger. That is to say, when a recording material bearing surface of the recording material bearing sheet 5*f* is charged positively and the rear surface of the recording material bearing sheet is charged negatively with a polarity the same as that of the charger 2, since the negative (minus) charge accumulated on the recording material bearing sheet 5*f* flows through the transfer charger 5, an area which is charged positively is created on the photosensitive drum 1 which is electrically earthed.

As shown in FIGS. 9A to 9C, if there are positive (plus) potential and negative (minus) potential on the photosensitive drum 1, even after the photosensitive drum is subjected to the electricity removal (for making the minus potential to zero potential) effected by the pre-exposure lamp 11, the plus potential is not removed (FIG. 9B). Thus, in the first color image formation, there arises a problem that the positively charged areas on the photosensitive drum affect a bad influence upon the image (FIG. 9C). In particular, a half-tone image of the hi-light portion is strongly affected by the history of the plus charge.

SUMMARY OF THE INVENTION

Accordingly, an object of the present invention is to reduce an image forming time period.

Another object of the present invention is to provide an image forming apparatus which can perform good image formation.

A further object of the present invention is to prevent an image bearing member from being charged with polarity opposite to that of a charge means.

The other objects and features of the present invention will be apparent from the following detailed explanation of the present invention referring to the accompanying drawings.

DETAILED DESCRIPTION OF THE PREFERRED EMBODIMENTS

The present invention will now be explained with reference to the accompanying drawings.

Figure 1:
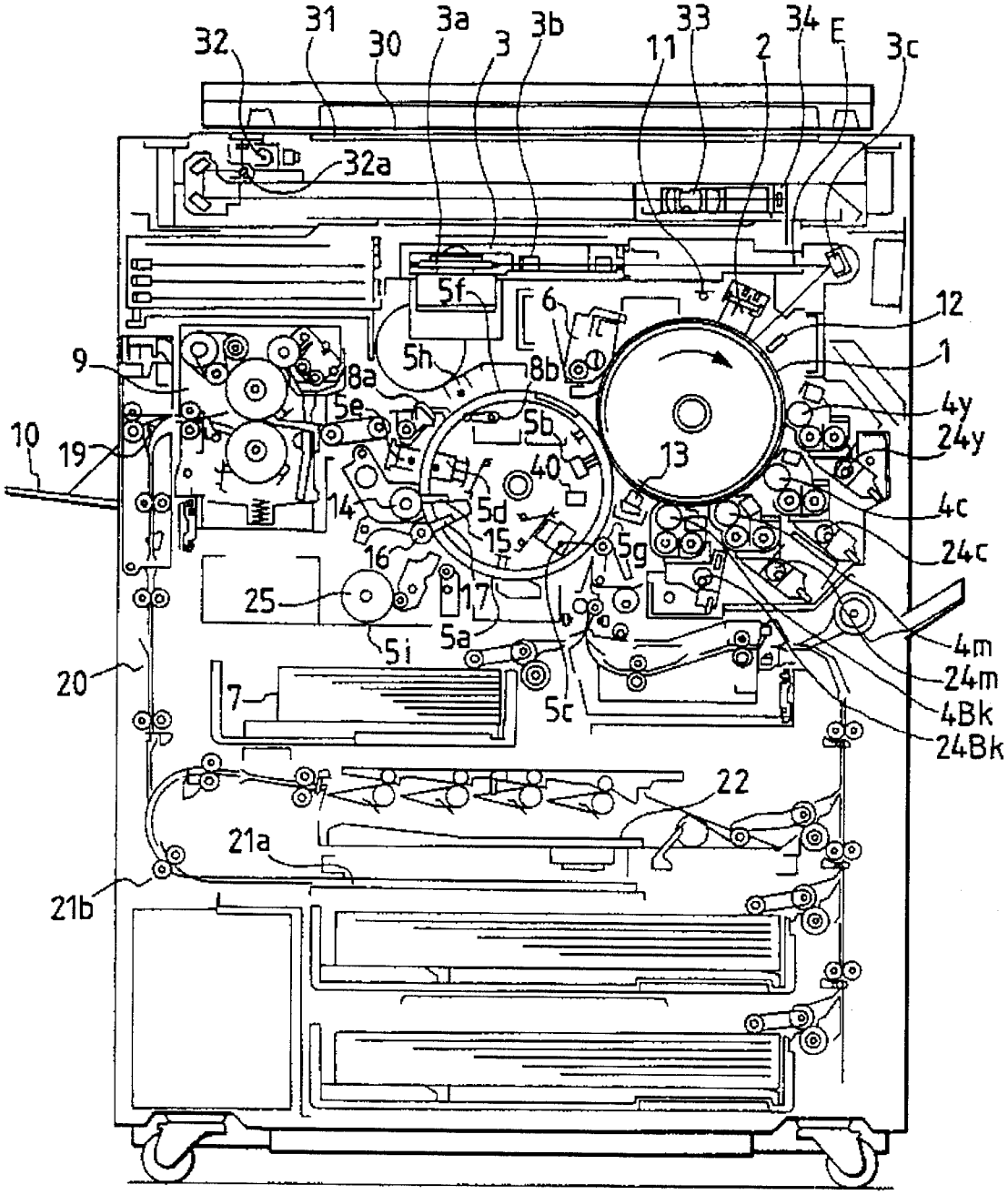
FIG. 1 is a sectional view of a full-color image forming apparatus according to a preferred embodiment of the present invention.
Figure 2:
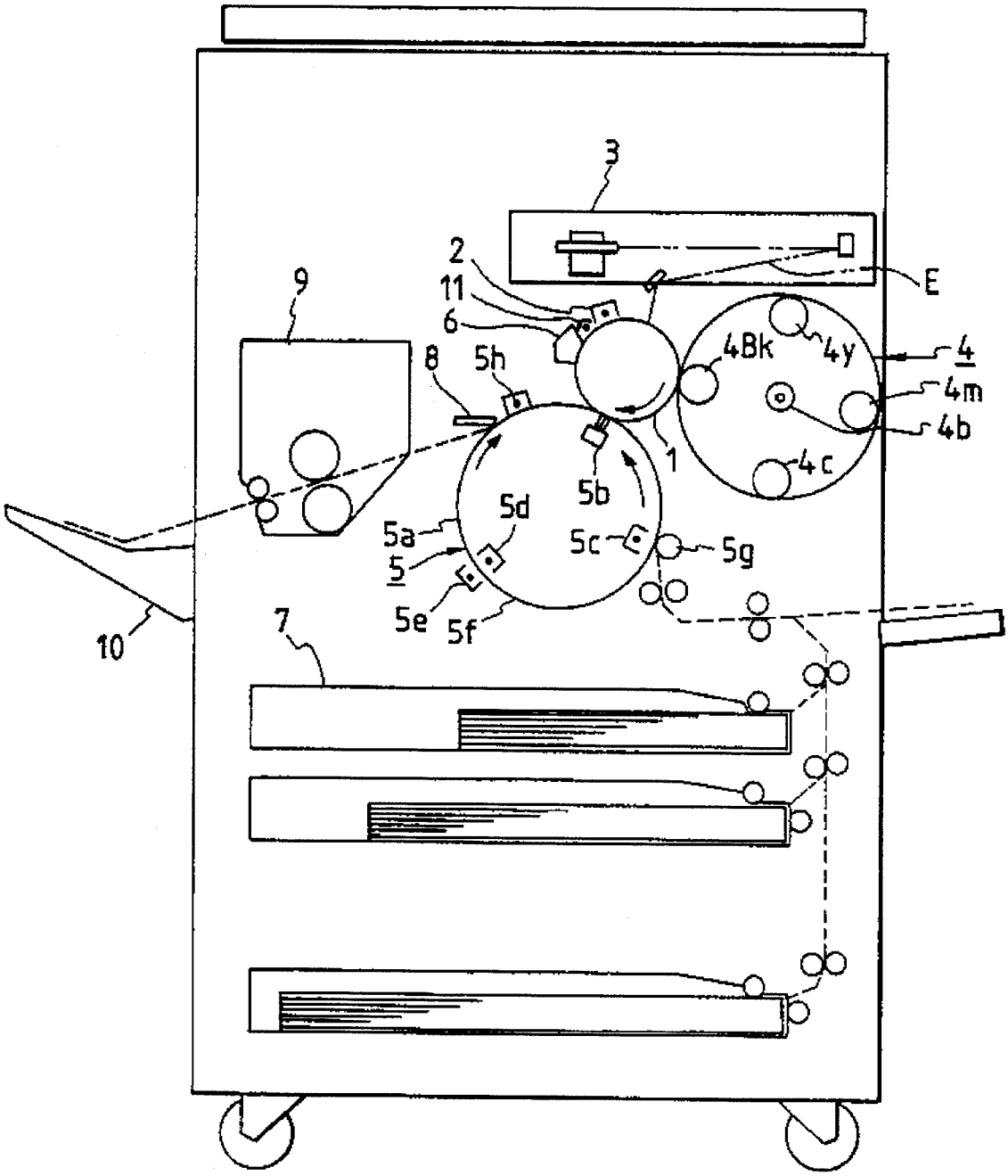
FIG. 2 PRIOR ART
FIG. 2 is a sectional view showing an example of a full-color image forming apparatus.

FIG. 1 is a schematic sectional view of a color image forming apparatus according to a preferred embodiment of the present invention which includes an upper digital color image reader portion and a lower digital color image printer portion.

In the reader portion, an original 30 is rested on an original support glass 31. By exposure-scanning the original by an exposure lamp 32, a light image reflected from the original by a lens 32A is focused on a full-color sensor 34 by a lens 33, thereby obtaining a color-decomposed image signal. The color-decomposed image signal is sent through an amplifier circuit (not shown) to a video treatment unit (not shown), where the signal is treated. The treated signal is sent to the printer portion. In the printer portion, a photosensitive drum (image bearing member) 1 is supported for rotational movement. Around the photosensitive drum 1, there are arranged a pre-exposure lamp 11, a corona charger (charge means) 2, a laser exposure optical system 3, a potential sensor 12, four different color developing devices 4*y*, 4*c*, 4*m*, 4B*k*, a drum light amount detection means 13, a transfer device 5 and a cleaning device 6. In the laser exposure optical system 3, the image signal sent from the reader portion is converted into an image scan exposure light signal at a laser output portion (not shown), and the converted laser signal is reflected by a polygon mirror 3*a* to be projected on a surface of the photosensitive drum 1 through a lens 3*b* and a mirror 3*c*.

In the image formation at the printer portion, the photosensitive drum 1 is rotated in a direction shown by the arrow. After the electricity on the photosensitive drum is removed by the pre-exposure lamp 11, the photosensitive drum 1 is uniformly charged with minus potential by the charger 2. During the same revolution of the photosensitive drum 1, the light image E for each color is illuminated onto the drum, thereby forming a latent image.

Then, a selected developing device is activated to develop the latent image with toner having resin as a main component, thereby forming a negatively charged toner image. The developing devices 4*y*, 4*c*, 4*m*, 4B*k* are selectively approached to the photosensitive drum 1 in accordance with the decomposed color by means of eccentric cams 24*y*, 24*c*, 24*m*, 24B*k*.

Further, the toner image formed on the photo-sensitive drum 1 is transferred onto a recording material sent, by a convey system from a recording material cassette 7 to a transfer station where the transfer device 5 is opposed to the photosensitive drum 1. In the illustrated embodiment, the transfer device 5 comprises a transfer drum (recording material bearing member) 5*a*, a transfer brush charger (transfer means) 5*b*, an absorb corona charger 5*c* for electrostatically absorbing the recording material and an absorb roller 5*g* opposed to the absorb corona charger, an inner corona charger 5*d*, and an outer corona charger 5*e*. A peripheral opening of the transfer drum 5*a* supported for rotational movement is covered or closed by a cylindrical recording material bearing sheet 5*f* made of dielectric material. Preferably, the recording material bearing sheet 5*f* is formed from dielectric sheet such as a polycarbonate film.

As the drum-shaped transfer device (i.e., transfer drum 5*a*) is rotated, the toner image formed on the photosensitive drum 1 is transferred onto the recording material born on the recording material bearing sheet 5*f* by charging a rear surface (back surface) of the transfer material bearing sheet 5*f* (opposed to a recording material bearing surface thereof) with plus polarity.

In this way, a desired number of color images are transferred to the recording material born on the recording material bearing sheet 5*f*, thereby forming a full-color image. In case of the full-color image formation, after the four color toner images were transferred to the single recording material, the recording material is separated from the transfer drum 5*a* under the action of a separation pawl 8*a*, a separation push-up roller 8*b* and the separation charger 5*h*, and the separated recording material is discharged onto a tray 10 through a heat roller fixing device 9.

On the other hand, after the transferring operation, the residual toner remaining on the photo-sensitive drum 1 is removed by the cleaning device 6 for preparation for next image formation.

When images are formed on both surfaces of the recording material, after the recording material is discharged from the fixing device 9, a convey path switching guide 19 is promptly driven to direct the recording material to a reverse rotation path 21*a* through a vertical convey path 20 temporarily. Then, by rotating a reverse rotation roller 21*b* reversely, the recording material is returned toward a direction opposite to a direction that the recording material is introduced into the reverse rotation path, thereby storing the recording material on an intermediate tray 22. Thereafter, by performing a next image formation process, an image is formed on the other surface of the recording material.

Further, in order to prevent the scattering and adhesion of powder onto the recording material bearing sheet 5*f* of the transfer drum 5 and adhesion of oil to the recording material, the recording material bearing sheet is cleaned by a fur brush 14, a back-up brush 15 opposed to the fur brush 14 with the interposition of the recording material bearing sheet 5*f*, an oil removing roller 16, and a back-up brush 17 opposed to the oil removing roller 16 with the interposition of the recording material bearing sheet 5*f*. Such a cleaning operation may be effected before or after the image formation, and is always effected if a jam (jamming of the recording material) occurs.

Further, in the illustrated embodiment, a gap between the recording material bearing sheet 5*f* and the photosensitive drum 1 can be adjusted by driving an eccentric cam 25 at a predetermined timing to drive a cam follower 5*i* secured to the transfer drum 5. For example, the transfer drum is separated from the photosensitive drum in a stand-by condition or a power OFF condition.

Figure 4:
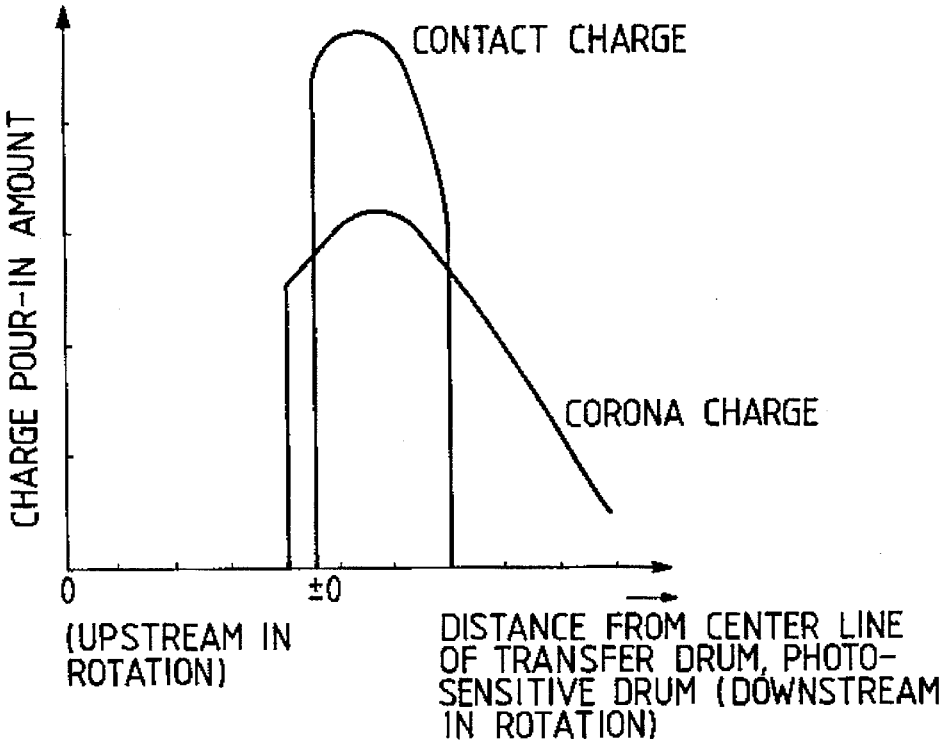
FIG. 4 is a graph showing charge pour-in amounts due to contact charge and corona charge.

FIG. 4 shows a relation between a charge pour-in amount and a position at the transfer station when contact charge means and corona charge means are used as transfer means for effecting charge pour-in. As shown in FIG. 4, it is possible to concentrate the charge within a narrower area by using the contact charge means with a simple construction in comparison with the corona charge means. Accordingly, by using the contact charge means as charge pour-in means at the transfer station, the charge pour-in at the transfer station can be performed more effectively.

Figure 3:
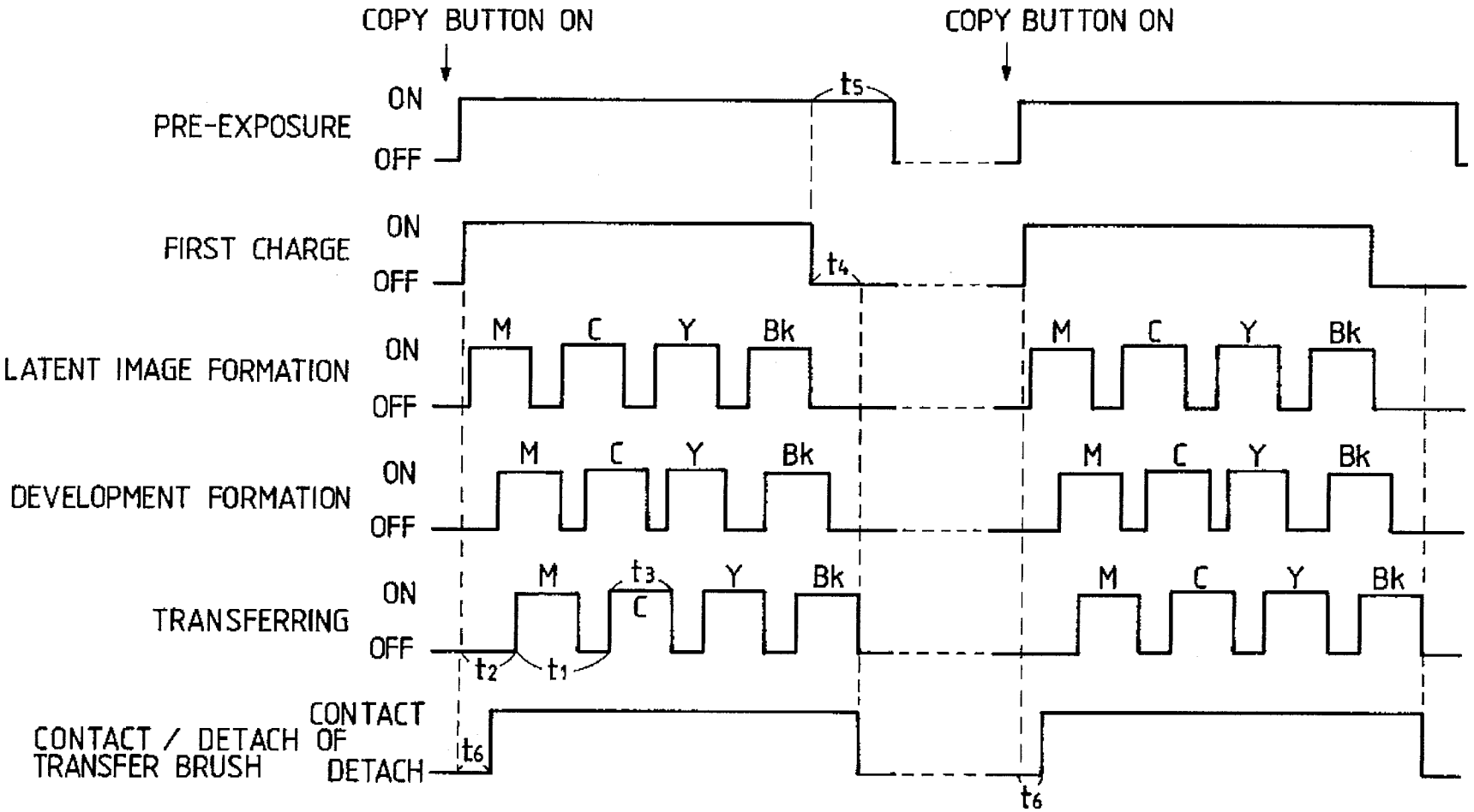
FIG. 3 is a sequence chart showing image formation according to the present invention.

FIG. 3 shows sequences regarding the pre-exposure effected by the pre-exposure lamp 11, first charge effected by the corona charger 2, latent image formation effected by the laser exposure optical system 3, development formation effected by the developing devices 4*y*, 4*c*, 4*m*, 4B*k*, transferring effected by the transfer brush charger 5*b*, and contact/detach between the transfer brush charger 5*b* and the recording material bearing sheet 5*f*, according to the illustrated embodiment.

When the image formation start signal is inputted from an external device to the image forming apparatus by depressing a copy button and the rotation of the photosensitive drum 1 is started, the pre-exposure is firstly effected, and then, the first charge is started in synchronous with a timing when a tip end of an image forming area on the photosensitive drum 1 (an area which is to be contacted with a tip end of the recording material during the transferring operation) reaches a first charge station. Then, the latent image formation for forming the latent image corresponding to the magenta color image is started in synchronous with a timing when the tip end of the image forming area on the photosensitive drum 1 reaches a latent image forming station, and then, the magenta developing device 4*m* is operated in synchronous with a timing when the tip end of the image forming area on the photosensitive drum reaches the developing device 4*m*. Then, the transferring of the toner image by means of the transfer brush charger 5*b* is started in synchronous with a timing when the tip end of the image forming area on the photosensitive drum reaches the transfer station. That is to say, in the illustrated embodiment, the pre-rotation is not performed, but from the first charge to transferring are effected during one revolution of the photosensitive drum 1.

The latent image formation, development formation and transferring are effected within a time period $t_3$ within which the tip end of the image forming area on the photosensitive drum passes through the latent image forming station, developing station and transfer station, respectively. Similarly, a cyan color image, a yellow color image and a black color image are formed, and four color (magenta, cyan, yellow and black) toner images are transferred onto the recording material in a superimposed fashion.

In FIG. 3, $t_1$ indicates a time period required for rotating the photosensitive drum 1 by one revolution, $t_2$ indicates a time period required for shifting the tip end of the image forming area on the photosensitive drum from the first charge station to the transfer station, $t_4$ indicates a time period from the finish of the first charge to the detach of the transfer brush charger 5*b* (from the transfer drum 5*a*), and $t_5$ indicates a time period from the finish of the charge to the finish of the pre-exposure. In the illustrated embodiment, the time period $t_4$ is set so that the plus charge is not generated on the photosensitive drum 1. That is to say, by setting to $t_4<t_2$, while the transfer brush charger 5*b* is being contacted with the recording material bearing sheet 5*f*, the photosensitive drum 1 passes through the transfer station in a condition that the photosensitive drum is charged negatively. Further, the time period $t_5$ is set to be greater than a time period within which the photosensitive drum 1 is shifted from the first charge station to the pre-exposure station, in order to permit complete removal of the minus charge from the photosensitive drum 1 by means of the corona charger 2.

Incidentally, $t_6$ indicates a time period from the start of the first charge to the start of contact between the transfer brush charger 5*b* and the transfer drum 5*a*. In the illustrated embodiment, the time period $t_6$ is selected to have a relation $\{(t_3-(t_1-t_2))<t_6\leqq t_2\}$. With this arrangement, if a length of the recording material along a circumference of the transfer drum 5*a* is greater than a distance between transfer station and the first charge station along a circumference of the photosensitive drum 1, when the first charge is started, since a trailing end of the image forming area on the photosensitive drum 1 (an area which is to be contacted with the recording material during the transferring operation) is positioned at a downstream side of the transfer station in a rotational direction of the photosensitive drum 1, a time period $\{t_3-(t_1-t_2)\}$ is required for passing the trailing end of the image forming area through the transfer station after the first charge was started. Accordingly, the contact of the transfer brush charger 5*b* with the transfer drum 5*a* is started after at least the time period $\{t_3-(t_1-t_2)\}$ is elapsed after the first charge. Further, in order to contact the transfer brush charger 5*b* with the transfer drum 5*a* prior to the transferring operation, a relation $(t_6\leqq t_2)$ is selected.

With this arrangement, the area on the photosensitive drum 1 which is to be contacted with the recording material during the transferring operation can be prevented from being charged positively at the transfer station prior to the transferring operation. By the way, if the length of the recording material along the circumference of the transfer drum 5*a* is smaller than the distance between transfer station and the first charge station along the circumference of the photosensitive drum 1, the value $\{t_3-(t_1-t_2)\}$ becomes minus, and, thus, the value $t_6$ can be made minus. That is to say, it is possible to contact the transfer brush charger 5*b* with the transfer drum 5*a* before the start of the first charge within a range defined by the aforementioned relation. When the transfer brush charger 5*b* is contacted with the transfer drum 5*a* before the start of the first charge in this way, vibration generated due to the contact can be prevented from affecting a bad influence upon the first charge and/or latent image formation.

After the transferring operation, the transfer brush charger 5*b* is promptly separated from the transfer drum 5*a* by a contact/detach means 40 such as a solenoid.

Figure 5:
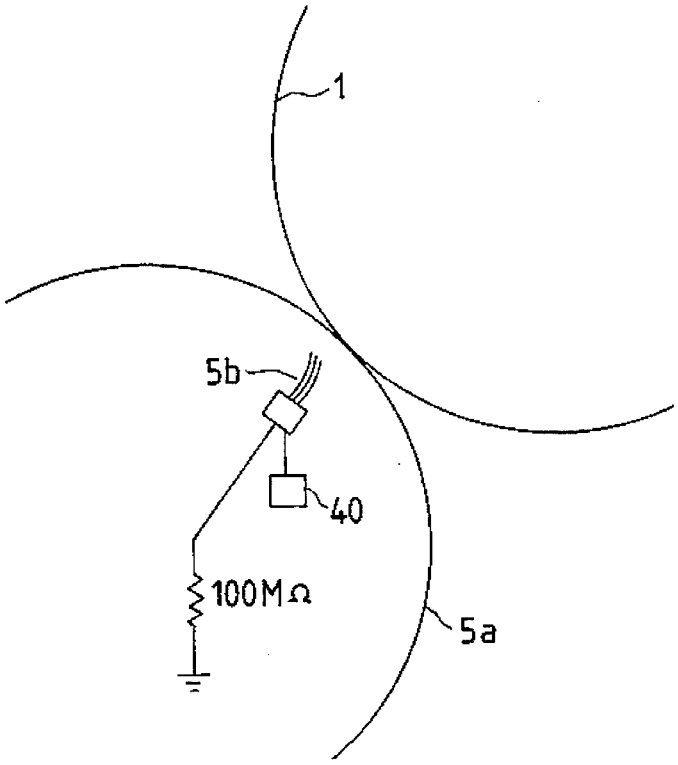
FIG. 5 is an explanatory view showing a transfer station and therearound.

As mentioned above, in the illustrated embodiment, the first charge effected by the corona charger (charge means) 2, latent image formation and development formation effected by the laser exposure optical system 3 and developing devices 4*m*, 4*c*, 4*y* and 4B*k* (image forming means), and transferring effected by the transfer brush charger (transfer means) 5*b* are started during one revolution of the photosensitive drum 1. When the image forming area on the photosensitive drum 1 which is to be contacted with the recording material during the transferring operation is positioned at the transfer station at least before the transferring is started, the transfer brush charger 5*b* is separated from the recording material bearing sheet 5*f* of the transfer drum 5*a*. That is to say, a tip end of a charge brush of the transfer brush charger 5*b* is separated from the recording material bearing sheet 5*f* by 5 mm as shown in FIG. 5 to electrically isolate them from each other, thereby preventing the charge on the recording material bearing sheet 5*f* from being transferred or transmitted, so that, even if an inner surface of the recording material bearing sheet 5*f* is charged to about −4 kV and an outer surface thereof is charged to about +4 kV, a discharging phenomenon does not occur. Accordingly, since the image forming area on the photosensitive drum 1 which is to be contacted with the recording material during the transferring operation can be prevented from being charged positively, it is possible to obtain the uniform image having no history regarding the plus charge of the photosensitive drum 1.

Further, in the illustrated embodiment, as shown in FIG. 5, by earthing the transfer brush charger 5*b* separated from the recording material bearing sheet 5*f* via a resistor of 100 Ω, the recording material bearing sheet 5*f* can be electrically isolated more effectively, thereby preventing the charge on the recording material bearing sheet 5*f* from being transferred or transmitted. Further, it was found that the same advantage can be obtained by using a plate-shaped elastic member in place of the transfer brush charger 5*b*.

Figure 6:
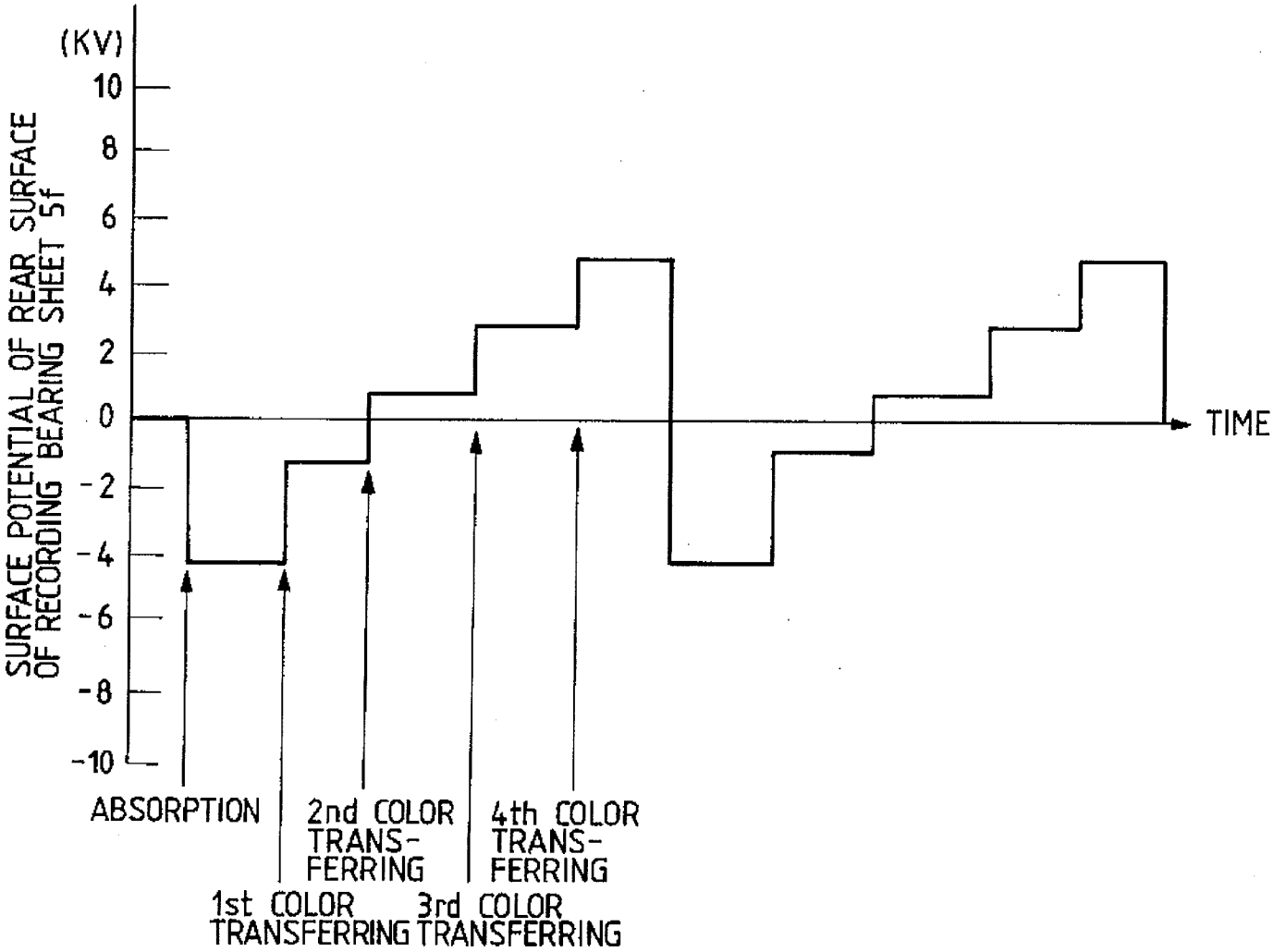
FIG. 6 is a graph showing surface potential of a rear surface of a recording material bearing sheet.
Figure 7A:
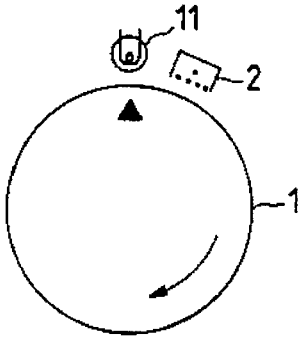
FIG. 7A PRIOR ART
FIGS. 7A to 7F are views for explaining image formation when a pre-rotation is effected.
Figure 7B:
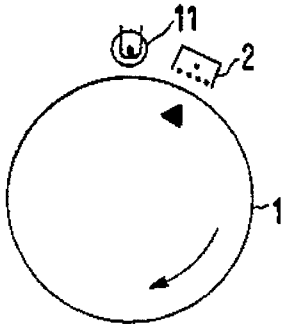
FIG. 7B PRIOR ART
Figure 7C:
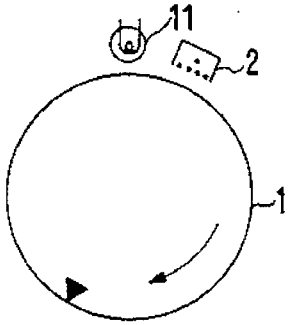
FIG. 7C PRIOR ART
Figure 7D:
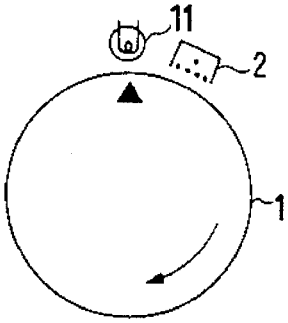
FIG. 7D PRIOR ART
Figure 7E:
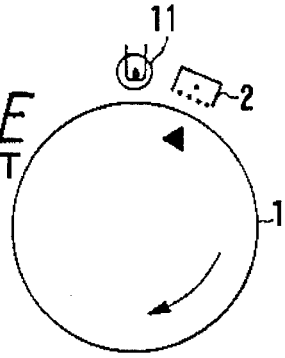
FIG. 7E PRIOR ART
Figure 7F:
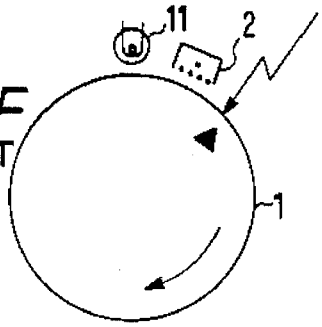
FIG. 7F PRIOR ART
Figure 8A:
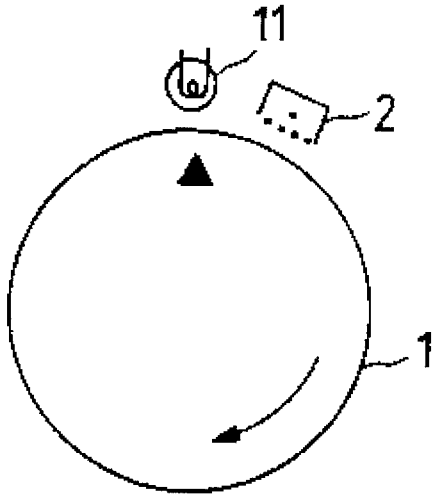
FIG. 8A PRIOR ART
FIGS. 8A to 8C are views for explaining image formation when the pre-rotation is omitted.
Figure 8B:
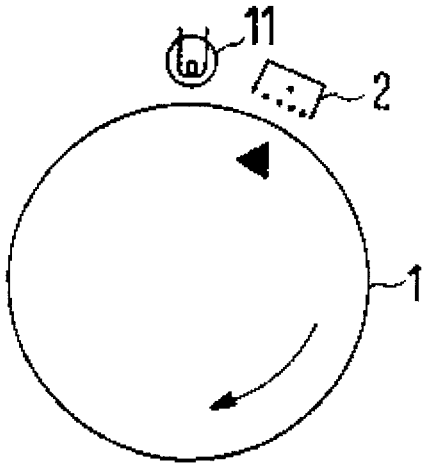
FIG. 8B PRIOR ART
Figure 8C:
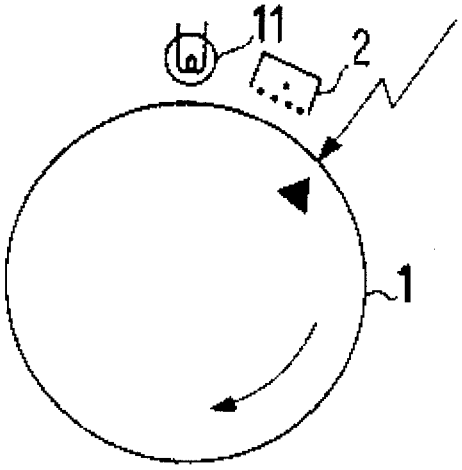
FIG. 8C PRIOR ART
Figure 9A:
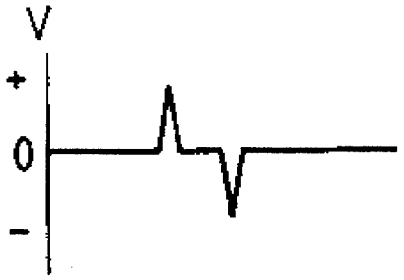
FIG. 9A PRIOR ART
FIGS. 9A to 9C are graphs showing potentials on a photosensitive drum when the pre-rotation is omitted.
Figure 9B:
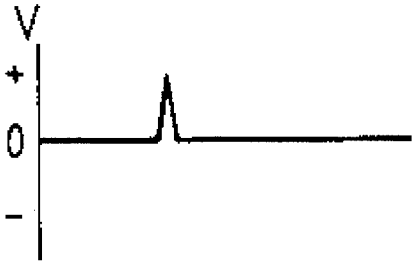
FIG. 9B PRIOR ART
Figure 9C:
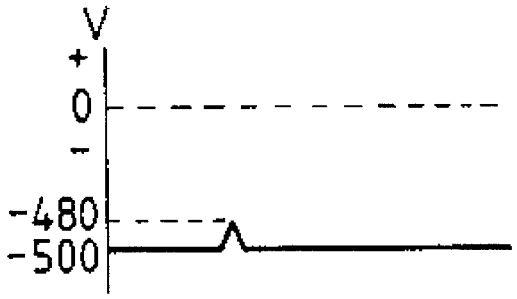
FIG. 9C PRIOR ART

Furthermore, in the image forming apparatus according to the illustrated embodiment, when the rear surface (opposite to the recording material bearing surface) of the recording material sheet 5*f* is charged with polarity opposite to the transferring polarity (i.e., with polarity same as the first charge polarity on the photosensitive drum 1) by the absorb corona charger 5*c* and the rear surface (opposite to the recording material bearing surface) of the recording material sheet 5*f* is charged with polarity opposite to that of the toner by the transfer brush charger 5*b*, during the series of operations, at a downstream side of a recording material absorbing position in the rotational direction of the transfer drum, a surface potential of the rear surface (opposite to the recording material bearing surface) of the recording material sheet 5*f* was measured. The result is shown in FIG. 6. In FIG. 6, the abscissa indicates "time" and the ordinate indicates "surface potential" of the rear surface of the recording material bearing sheet.

As shown in FIG. 6, immediately after the absorption, the surface potential of the rear surface of the recording material bearing sheet 5*f* is about −4 kV, which substantially corresponds to the DC bias applied to the absorb corona charger 5*c*. Further, whenever the transfer charge is applied for each color, the surface potential of the rear surface of the recording material bearing sheet 5*f* is gradually increased. As can be seen from the measured result of the surface potential of the rear surface of the recording material bearing sheet 5*f*, by charging the rear surface of the recording material bearing sheet with polarity opposite to the transferring polarity (i.e., with polarity same as the first charge polarity on the photosensitive drum 1), the recording material bearing sheet 5*f* can be stably used without overcharge even in the transferring operation for the fourth color.

In this case, since there is the charge on the recording material bearing sheet 5*f*, by electrically isolating the transfer brush charger 5*b* to prevent the charge on the recording material bearing sheet 5*f* from being transferred, it is well possible to achieve the advantage that the uniform image without the history of the plus charge can be obtained. In this case, the inside of the recording material bearing sheet 5*f* is charged to −4 kV and the outside thereof is charged to +4 kV before the first transferring.

Further, in the illustrated embodiment, by controlling the operation of the corona charger 2 and contact/detach of the transfer brush charger 5*b* so that the photosensitive drum passes through the transfer station always in the negatively charged condition when the transfer brush charger 5*b* is being contacted with the recording material bearing sheet 5*f*, the whole peripheral surface of the photosensitive drum 1 can be prevented from being charged positively. That is to say, the transfer brush charger 5*b* is contacted with the recording material bearing sheet 5*f* after the area (on the photosensitive drum 1) negatively charged by the corona charger 2 reaches the transfer station, and the transfer brush charger 5*b* is separated from the recording material bearing sheet 5*f* while the negatively charged area on the photosensitive drum 1 is being situated in the transfer station after the transferring of the last color image was finished.

What is claimed is:

1. An image forming apparatus comprising:

a rotatable image bearing member;

a first charge means for charging said image bearing member;

an image forming means for forming an image on said image bearing member charged by said first charge means;

a transfer material bearing member for holding and conveying a transfer material to a transfer station regarding said image bearing member;

a transfer means for electrostatically transferring the image formed on said image bearing member onto the transfer material held by said transfer material bearing member at said transfer station;

the charging effected by said first charge means, image formation effected by said image forming means and image transferring effected by said transfer means being started during the same revolution of said image bearing member; and a restraint means for preventing the charge on said transfer material bearing member from being transmitted, when an area on said image bearing member to be contacted with the transfer material held on said transfer material bearing member during the image transferring is situated at said transfer station before an operation of said transfer means is started.

2. An image forming apparatus according to claim 1, wherein said transfer means contacts with said transfer material bearing member to charge it, thereby transferring the image formed on said image bearing member onto the transfer material.

3. An image forming apparatus according to claim 2, wherein said transfer means has a brush which can be contacted with said transfer material bearing member.

4. An image forming apparatus according to claim 2, wherein said transfer means can be contacted with and detached from said transfer material bearing member, and said restraint means causes said transfer means to be detached from said transfer material bearing member when said area on said image bearing member to be contacted with the transfer material held on said transfer material bearing member during the image transferring is situated at said transfer station before the operation of said transfer means is started.

5. An image forming apparatus according to claim 4, wherein, after said area on said image bearing member to be contacted with the transfer material held on said transfer material bearing member during the image transferring passes through said transfer station, said transfer means is contacted with said transfer material bearing member before the image transferring effected by said transfer means is started.

6. An image forming apparatus according to claim 1, further comprising an electricity removal means for removing electricity from said image bearing member.

7. An image forming apparatus according to claim 1 or 4, wherein said restraint means causes said transfer means to be grounded via a resistor when said area on said image bearing member to be contacted with the transfer material held on said transfer material bearing member during the image transferring is situated at said transfer station before the operation of said transfer means is started.

8. An image forming apparatus according to claim 1, further comprising a second charge means for charging a rear surface of said transfer material bearing member opposite to a transfer material bearing surface of said transfer material bearing member before said transfer means is operated.

9. An image forming apparatus according to claim 8, wherein the transfer material is absorbed onto said transfer material bearing member by charging said transfer material bearing member by means of said second charge means.

10. An image forming apparatus according to claim 1, 4 or 8, wherein the charging polarity of said first charge means is opposite to that of said transfer means.

11. An image forming apparatus according to claim 1, wherein a plurality of images are successviely formed on said image bearing member, and said images are successively transferred onto the transfer material held on said transfer material bearing member in a superimposed fashion.

12. An image forming apparatus according to claim 11, wherein said first charge means continues to charge said image bearing member until the charging for forming a last image to be transferred onto the same transfer material is finished after said first charge means is operated.

13. An image forming apparatus according to claim 12, wherein, after an operation of said first charge means is stopped, said transfer means is detached from said transfer material bearing member while said area on said image bearing member which was charged by said first charge means is being situated at said transfer station.

14. An image forming apparatus according to claim 11, wherein a plurality of images are successively formed on said image bearing member, thereby forming a full-color image on the transfer material.

* * * * *